US007914376B2

(12) United States Patent
Walker et al.

(10) Patent No.: US 7,914,376 B2
(45) Date of Patent: Mar. 29, 2011

(54) METHOD AND APPARATUS FOR DETERMINING AND PRESENTING OUTCOMES AT A GAMING DEVICE

(75) Inventors: Jay S. Walker, Ridgefield, CT (US); James A. Jorasch, Stamford, CT (US); Geoffrey M. Gelman, Stamford, CT (US); Stephen C. Tulley, Fairfield, CT (US); Daniel E. Tedesco, Huntington, CT (US)

(73) Assignee: IGT, Reno, NV (US)

( * ) Notice: Subject to any disclaimer, the term of this patent is extended or adjusted under 35 U.S.C. 154(b) by 872 days.

(21) Appl. No.: 11/426,457

(22) Filed: Jun. 26, 2006

(65) Prior Publication Data

US 2006/0252486 A1 Nov. 9, 2006

Related U.S. Application Data

(63) Continuation of application No. 10/791,317, filed on Mar. 2, 2004, now abandoned.

(60) Provisional application No. 60/452,166, filed on Mar. 4, 2003.

(51) Int. Cl.
*A63F 9/24* (2006.01)

(52) U.S. Cl. ..... 463/25; 463/16; 463/22; 463/29; 463/30; 463/31; 463/40; 463/43; 273/138.1; 273/139

(58) Field of Classification Search ..... 463/16–22, 463/25, 29, 30, 31, 40–43; 273/138.1, 139
See application file for complete search history.

(56) References Cited

U.S. PATENT DOCUMENTS

| | | | | |
|---|---|---|---|---|
| 5,393,057 | A * | 2/1995 | Marnell, II | 463/13 |
| 5,769,716 | A * | 6/1998 | Saffari et al. | 463/20 |
| 5,770,533 | A * | 6/1998 | Franchi | 463/42 |
| 5,980,384 | A * | 11/1999 | Barrie | 463/16 |
| 6,033,307 | A | 3/2000 | Vancura | |
| 6,093,102 | A * | 7/2000 | Bennett | 463/20 |
| 6,227,971 | B1 * | 5/2001 | Weiss | 463/20 |
| 6,319,124 | B1 * | 11/2001 | Baerlocher et al. | 463/20 |
| 6,347,994 | B1 * | 2/2002 | Yoshikawa et al. | 463/7 |
| 6,394,902 | B1 | 5/2002 | Glavich et al. | |
| 6,464,581 | B1 | 10/2002 | Yoseloff et al. | |
| 6,533,273 | B2 | 3/2003 | Cole et al. | |
| 6,612,574 | B1 | 9/2003 | Cole et al. | |
| 6,612,575 | B1 | 9/2003 | Cole et al. | |
| 6,663,489 | B2 | 12/2003 | Baerlocher | |
| 6,846,238 | B2 * | 1/2005 | Wells | 463/39 |
| 6,857,958 | B2 * | 2/2005 | Osawa | 463/20 |
| 6,910,962 | B2 | 6/2005 | Marks et al. | |
| 6,913,532 | B2 | 7/2005 | Baerlocher et al. | |
| 6,942,574 | B1 * | 9/2005 | LeMay et al. | 463/41 |
| 6,955,600 | B2 | 10/2005 | Glavich et al. | |
| 6,960,133 | B1 | 11/2005 | Marks et al. | |
| 6,960,134 | B2 | 11/2005 | Hartl et al. | |
| 6,971,956 | B2 * | 12/2005 | Rowe et al. | 463/25 |
| 6,981,635 | B1 | 1/2006 | Hughs-Baird et al. | |
| 7,011,581 | B2 | 3/2006 | Cole et al. | |
| 7,066,814 | B2 | 6/2006 | Glavich et al. | |

(Continued)

*Primary Examiner* — Pierre E Elisca
(74) *Attorney, Agent, or Firm* — K&L Gates LLP

(57) ABSTRACT

A gaming device provides outcomes to the player of the gaming device by positioning symbols within a scrolling matrix. If the symbols position within the scrolling matrix matches a pay event outcome, the player may receive a benefit. In a first embodiment, the symbols are generated from the symbols of a basic game such as the symbols on a slot machine reel. The symbols are moved from the slot machine reel to the matrix.

18 Claims, 11 Drawing Sheets

U.S. PATENT DOCUMENTS

| | | | |
|---|---|---|---|
| 7,070,502 | B1 | 7/2006 | Bussick et al. |
| 7,094,148 | B2 | 8/2006 | Baerlocher et al. |
| 7,121,942 | B2 | 10/2006 | Baerlocher |
| 7,144,322 | B2 | 12/2006 | Gomez et al. |
| 7,235,011 | B2 | 6/2007 | Randall et al. |
| 7,258,611 | B2 | 8/2007 | Bigelow, Jr. et al. |
| 7,300,348 | B2 | 11/2007 | Kaminkow et al. |
| 7,322,887 | B2 | 1/2008 | Belger et al. |
| 7,341,513 | B2 | 3/2008 | Cuddy et al. |
| 7,357,713 | B2 | 4/2008 | Marks et al. |
| 7,357,716 | B2 | 4/2008 | Marks et al. |
| 7,381,134 | B2 | 6/2008 | Cuddy et al. |
| 7,402,102 | B2 | 7/2008 | Marks et al. |
| 7,473,174 | B2 | 1/2009 | Cuddy et al. |
| 7,513,826 | B2 | 4/2009 | Cuddy |
| 7,572,183 | B2 | 8/2009 | Olivas et al. |
| 7,578,740 | B2 | 8/2009 | Marks et al. |
| 7,607,980 | B2 | 10/2009 | Masci et al. |
| 7,618,316 | B2 | 11/2009 | Cole et al. |
| 7,625,280 | B2 | 12/2009 | Singer et al. |
| 7,666,083 | B2 | 2/2010 | Baerlocher et al. |
| 7,674,174 | B2 | 3/2010 | Marks et al. |
| 7,674,180 | B2 | 3/2010 | Graham et al. |
| 7,682,246 | B2 | 3/2010 | Cregan et al. |
| 7,690,982 | B2 | 4/2010 | Cuddy |
| 7,704,141 | B1 | 4/2010 | Marks et al. |
| 7,722,457 | B1 | 5/2010 | Marks et al. |
| 7,744,458 | B2 | 6/2010 | Marks et al. |
| 7,749,063 | B2 | 7/2010 | Belger et al. |
| 7,749,071 | B2 | 7/2010 | Marks et al. |
| 7,785,191 | B2 | 8/2010 | Marks et al. |
| 2002/0052232 | A1 | 5/2002 | Kaminkow |
| 2003/0064805 | A1* | 4/2003 | Wells ..... 463/39 |
| 2004/0048650 | A1 | 3/2004 | Mierau et al. |
| 2004/0195773 | A1 | 10/2004 | Masci et al. |
| 2005/0192081 | A1 | 9/2005 | Marks et al. |
| 2006/0030387 | A1 | 2/2006 | Jackson |
| 2006/0046830 | A1 | 3/2006 | Webb |
| 2006/0079314 | A1 | 4/2006 | Walker et al. |
| 2006/0089191 | A1 | 4/2006 | Singer et al. |
| 2006/0121969 | A1 | 6/2006 | Marks et al. |
| 2008/0090655 | A1 | 4/2008 | Marks et al. |
| 2008/0102931 | A1 | 5/2008 | Marks et al. |
| 2008/0113779 | A1 | 5/2008 | Cregan |
| 2008/0161095 | A1 | 7/2008 | Patterson et al. |
| 2008/0280673 | A1 | 11/2008 | Marks et al. |
| 2009/0104959 | A1 | 4/2009 | Caputo et al. |
| 2009/0104977 | A1 | 4/2009 | Zielinski |
| 2009/0124326 | A1 | 5/2009 | Caputo et al. |
| 2010/0041462 | A1 | 2/2010 | Singer et al. |
| 2010/0120493 | A1 | 5/2010 | Hoffman et al. |
| 2010/0124970 | A1 | 5/2010 | Pawloski et al. |

* cited by examiner

METHOD AND APPARATUS FOR DETERMINING AND PRESENTING OUTCOMES AT A GAMING DEVICE

RELATED APPLICATIONS

The present application is a continuation of U.S. patent application Ser. No. 10/791,317 filed Mar. 2, 2004, which claims the benefit of U.S. Provisional Application Ser. No. 60/452,166 filed Mar. 4, 2003, the disclosures of both which are hereby incorporated by reference in their entireties.

FIELD OF THE INVENTION

The present invention relates to a gaming device and in particular to a method of presenting outcomes at a gaming device.

DETAILED DESCRIPTION OF THE INVENTION

Figure 1:
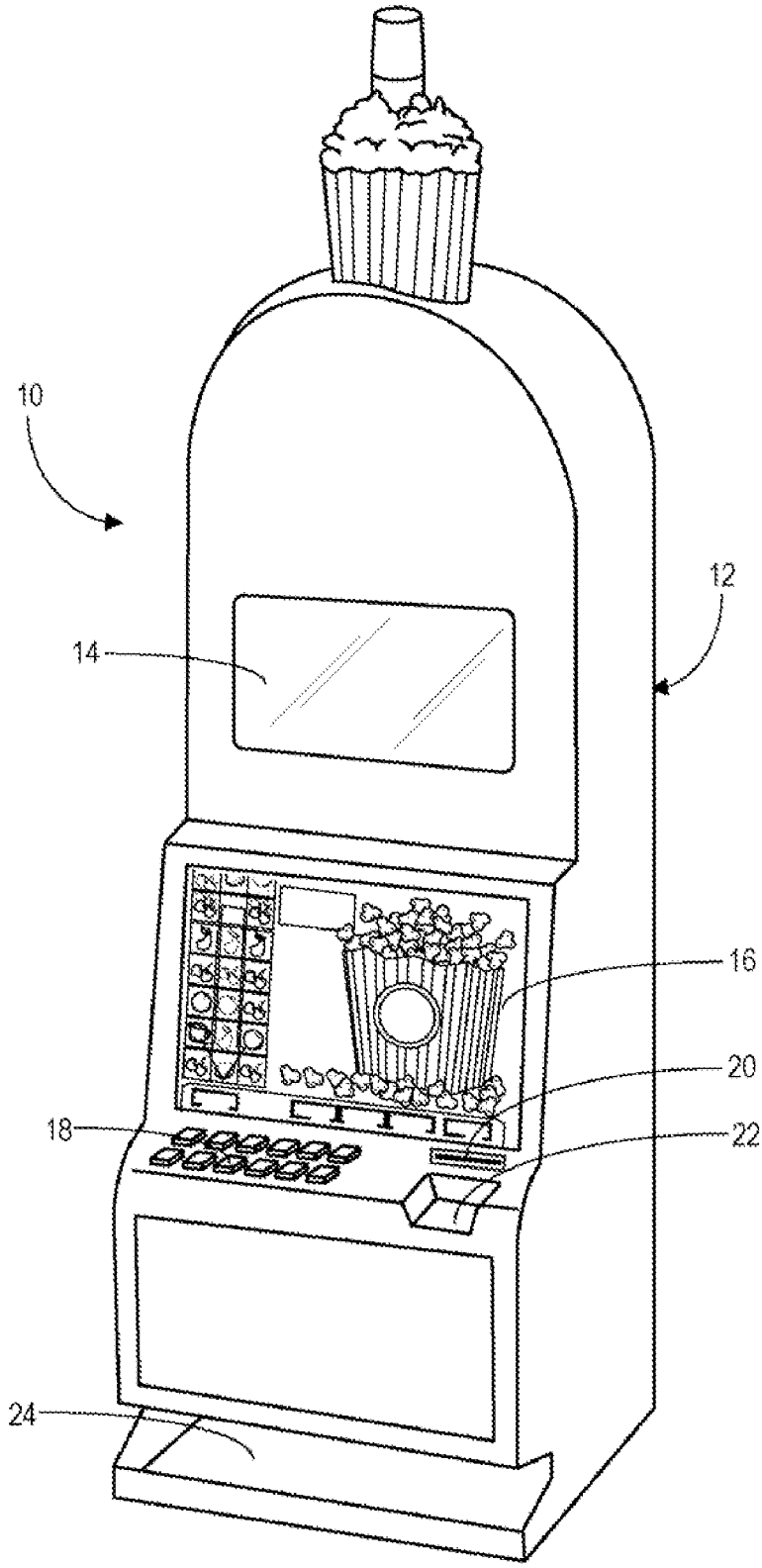
FIG. 1 illustrates an exemplary gaming device according to one embodiment of the present invention.

Gaming devices such as slot machines and video poker machines generate more than $15 billion per year in revenue for casinos in the United States alone and account for more than half of the gaming revenue for a typical United States casino. Accordingly, casino operators are interested in increasing the enjoyment of playing a slot machine so as to increase the revenue derived therefrom.

Embodiments of the present invention are directed to providing an entertaining game on a gaming device. In a first embodiment, the gaming device provides a popcorn themed game. The players purchase a number of unpopped kernels of popcorn. As game play commences, the kernels pop. After popping, a game symbol is associated with each unit of popcorn. The kernels, and their corresponding game symbols, fall towards a secondary screen. As the popcorn falls, the popcorn fades away leaving the game symbols to fall into a matrix on the secondary screen. The game symbols form game outcomes in the matrix such that rows, columns, and diagonals of symbols may result in payouts for the player. As the matrix fills, the bottom rows of the matrix scroll off the secondary screen, accelerating the dynamic feel of the gaming device. In a secondary embodiment, the gaming device moves away from the popcorn theme and resembles a more traditional slot machine. The player plays the slot machine and symbols appear on the reels. The symbols are then moved graphically from the reels to a matrix on a secondary screen. Again, the symbols form game outcomes in the matrix such that rows, columns, and diagonals of symbols may result in payouts for the player. As the matrix fills, the bottom rows of the matrix scroll off the secondary screen.

Before addressing the particularly contemplated embodiments of the present invention, a few definitions are provided to facilitate understanding of concepts presented herein.

Basic Game: a game associated with a handle pull, see also meta-game.

Bonus Payout: a payout awarded in a meta-game, see also payout

Controller: an electronic device (e.g., a computer) that communicates with one or more gaming devices. The controller may function as a computer server and may control the actions of gaming devices. The controller may also contain databases to record statistics such as coin-in, coin-out, jackpot information, theoretical wins, and the like.

Display Matrix: a visual display area of an output device operatively connected to a gaming device that is designated to represent the accumulation of at least two game elements such as symbols, icons, and/or outcomes. In some embodiments, a display matrix includes at least two sub-areas, "cells", slots, or other subdivisions that can be populated with accumulated game elements. Further, in some embodiments, the relative position of accumulated game elements within a display matrix may qualify a player for a payout or bonus payout.

Game: a wagering activity whereby a player posts consideration, usually monetary in form, in exchange for a chance at winning a payout. Specifically included are basic games and meta-games.

Game Device, Gaming Device: any electrical, mechanical, or electromechanical device that accepts wagers, steps through a process to determine an outcome, and pays winnings based on the outcome. The outcome may be randomly generated, as with a slot machine; may be generated through a combination of randomness and player skill, as with video poker; or may be generated entirely through player skill. Gaming devices may include slot machines (both video and mechanical reels), video poker machines, video blackjack machines, pachinko machines, video lottery terminals, handheld gaming devices, and the like.

Game Session, Gaming Session, Session: a gambling event with a beginning and end that may encompass a number of spins or span of time. The end of the game may be determined voluntarily (in which the player elects to stop) or involuntarily (in which the gaming device terminates play). A game session is typically correlated with a meta-game, such that a meta-game is resolved on completion of a game session.

Handle Pull, Pull, Spin, Game Start, Discrete Game Play: a single play at a gaming device that generates a single outcome, whether or not a handle is involved in the play and whether or not a handle is even included in the gaming device. The definition is intended to be flexible in that a single play might constitute a single complete game, or a single wager. Handle pulls are generally associated with discrete outcomes that may yield individual payouts.

Meta-Game: a game associated with a game session, as opposed to a specific isolated handle pull. Meta-games involve the aggregation of collected symbols. Synonymous with bonus game as a meta-game or bonus game has a bonus payout. See also basic game.

Outcome(s): the result(s) of gaming event(s) that may be used in determining payout or bonus payout eligibility. Outcomes may be associated (i) individual symbols that independently can be used to determine payout eligibility (e.g., a single cherry symbol outcome yields a payout), and/or (ii) a combination of individual symbols that are used to determine payout or bonus payout eligibility (e.g., a cherry-cherry-cherry outcome in a basic slot machine, or the aggregation of three cherries in a meta-game). Other example outcomes include a push in blackjack and a flush in video poker. Different types of gaming devices may have widely varying types of outcomes.

Payout: the prize, reward, benefit or winnings associated with a certain outcome in a basic game. See also bonus payout.

Prepaid Session: time or handle pulls that are paid for in advance. Once a session is prepaid, the player does not need to supply any additional funds until the session has been completed. A prepaid session may allow the player to complete many games during the session.

FIG. 1 illustrates an exemplary gaming device 10 according to one embodiment of the present invention. The gaming device 10 may be formed in a housing 12. Within housing 12, a first display 14 and a second display 16 may be positioned. As illustrated, the first display 14 is positioned above the second display 16. The housing 12 may also include a user keypad 18, a player-tracking card reader 20, a cash acceptor 22, and a coin hopper 24. While not illustrated, the gaming device 10 has a controller, which may be a microprocessor and/or software that facilitate functions of the gaming device 10.

Figure 2:
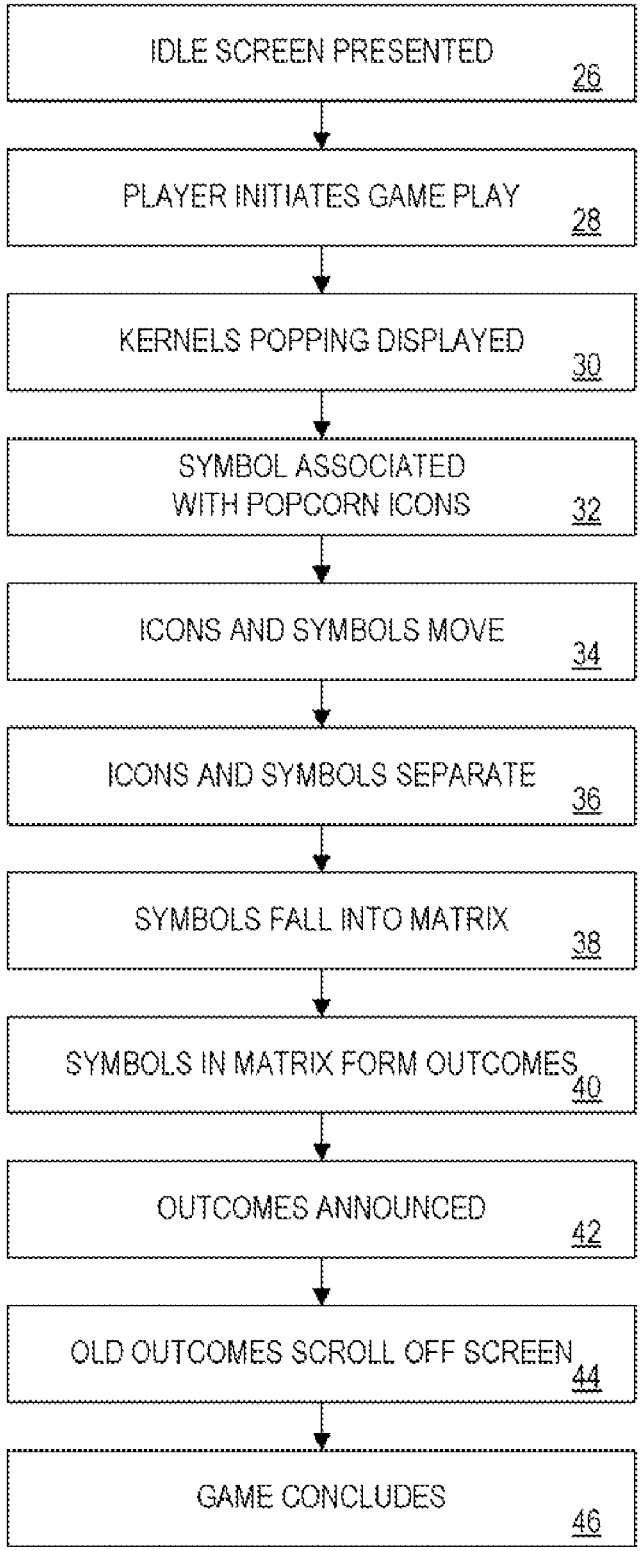
FIG. 2 illustrates as a flow chart exemplary game play on the gaming device of FIG. 1.

FIG. 2 illustrates exemplary game play on the gaming device 10. The explanation of game play is facilitated by reference to the screen shots in the later figures. When the gaming device 10 is not in use, a dynamic idle screen may be presented on the displays 14 and 16 along with accompanying audio if needed or desired (block 26). The use of idle screens is not central to the present invention and further discussion is foregone.

Figure 3:
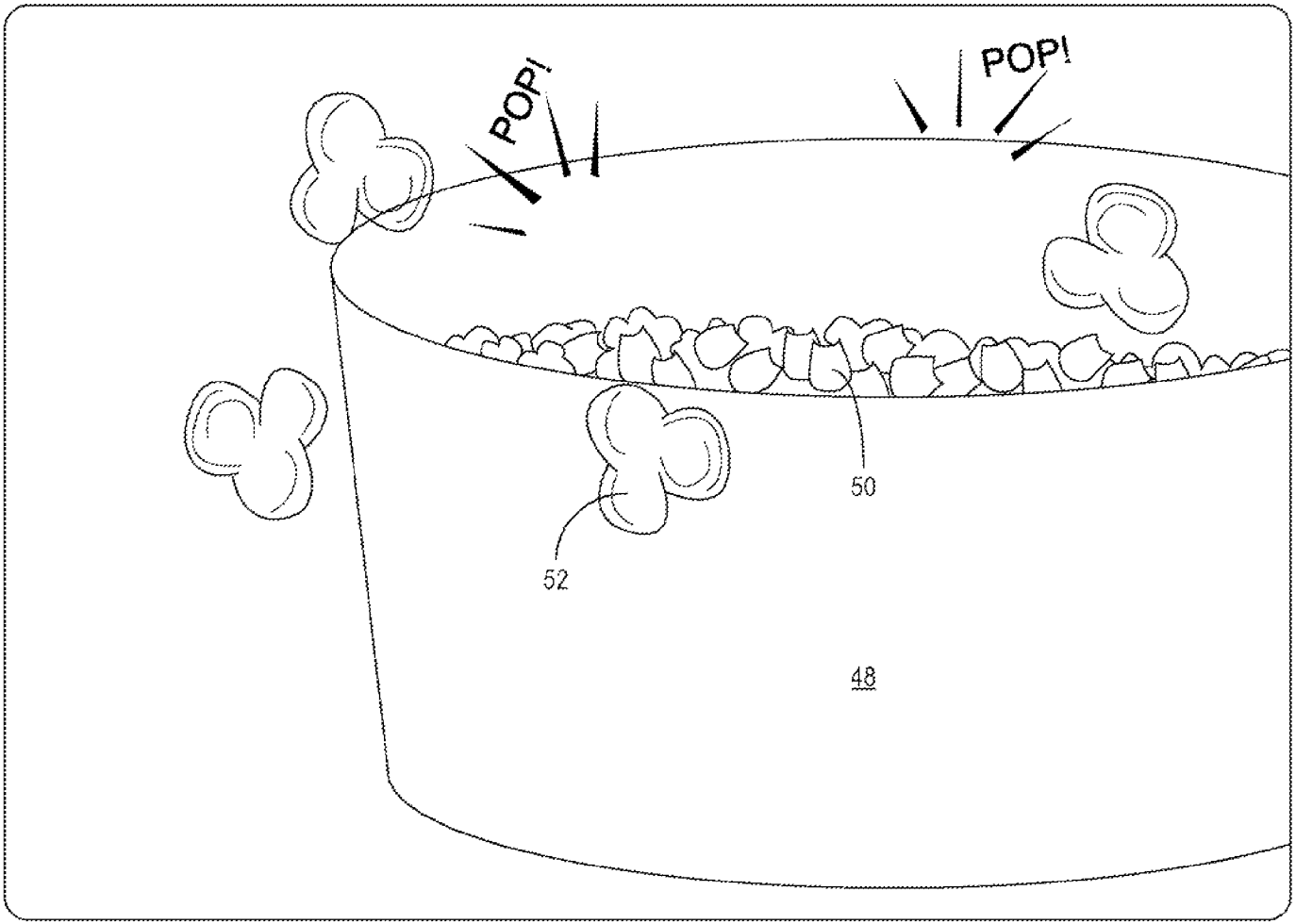
FIG. 3 illustrates a first exemplary screen shot as game play begins for the gaming device of FIG. 1.

The player initiates game play (block 28) such as through the insertion of cash into the cash acceptor 22, using a credit card, or the like and by pressing a button on the user keypad 18. On the first display 14, a tub 48 is presented with kernels 50 stored therein (FIG. 3). The animation may show the tub 48 being applied to a heat source and initial agitation as the kernels begin to cook. After some dramatic showmanship to enliven the process, the kernels 50 pop into popcorn icons 52 (block 30). Initially, the rate of popping may be slow as happens when kernels are cooked to make popcorn.

Figure 4:
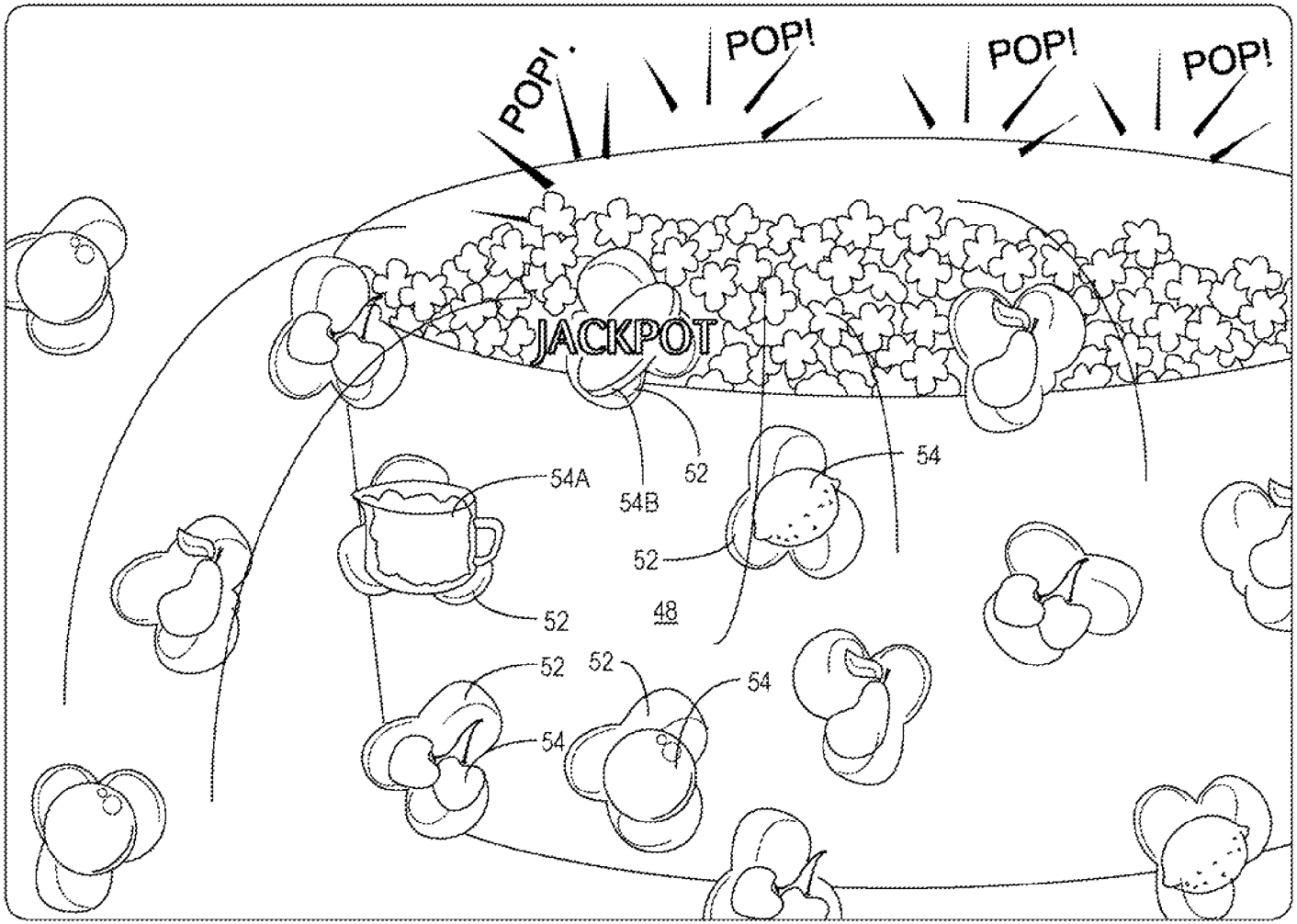
FIG. 4 illustrates a second exemplary screen shot as game play proceeds for the gaming device of FIG. 1.

As the popcorn icons 52 fly out of the tub 48, symbols 54 are associated with the popcorn icons 52 (block 32 and FIG. 4). In an exemplary embodiment, the association is effectuated by superimposing the symbols 54 on the popcorn icons 52. In an alternate embodiment, the association is effectuated by transforming the popcorn icon 52 into the symbol 54. Some symbols 54 like kernel symbol 54A may add kernels 50 to the tub 48, in effect extending game play. Other symbols 54, such as jackpot symbol 54B may provide immediate outcomes if needed or desired.

Figure 5:
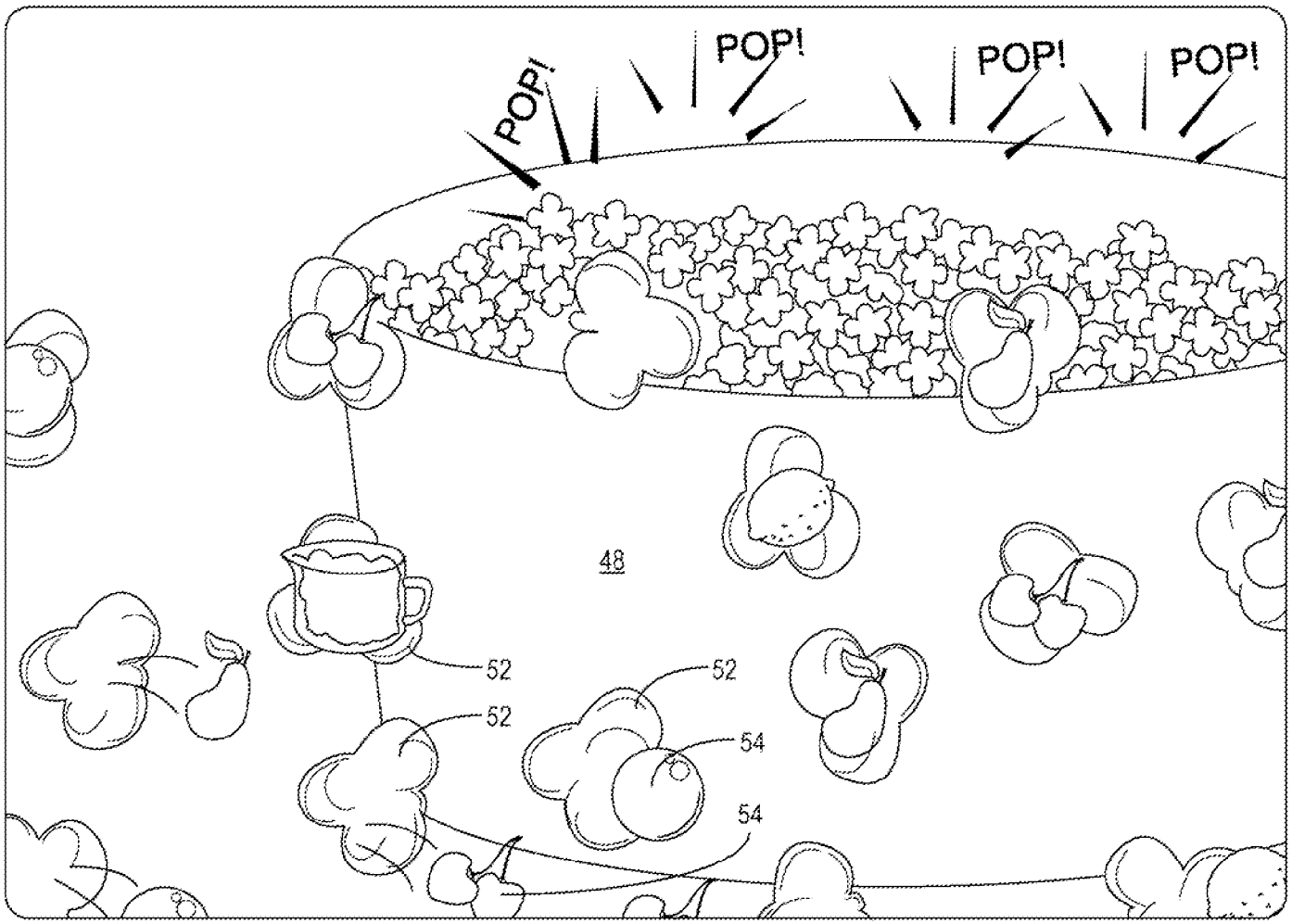
FIG. 5 illustrates a third exemplary screen shot for the gaming device of FIG. 1 highlighting the separation of the symbols from the transition icons.
Figure 6:
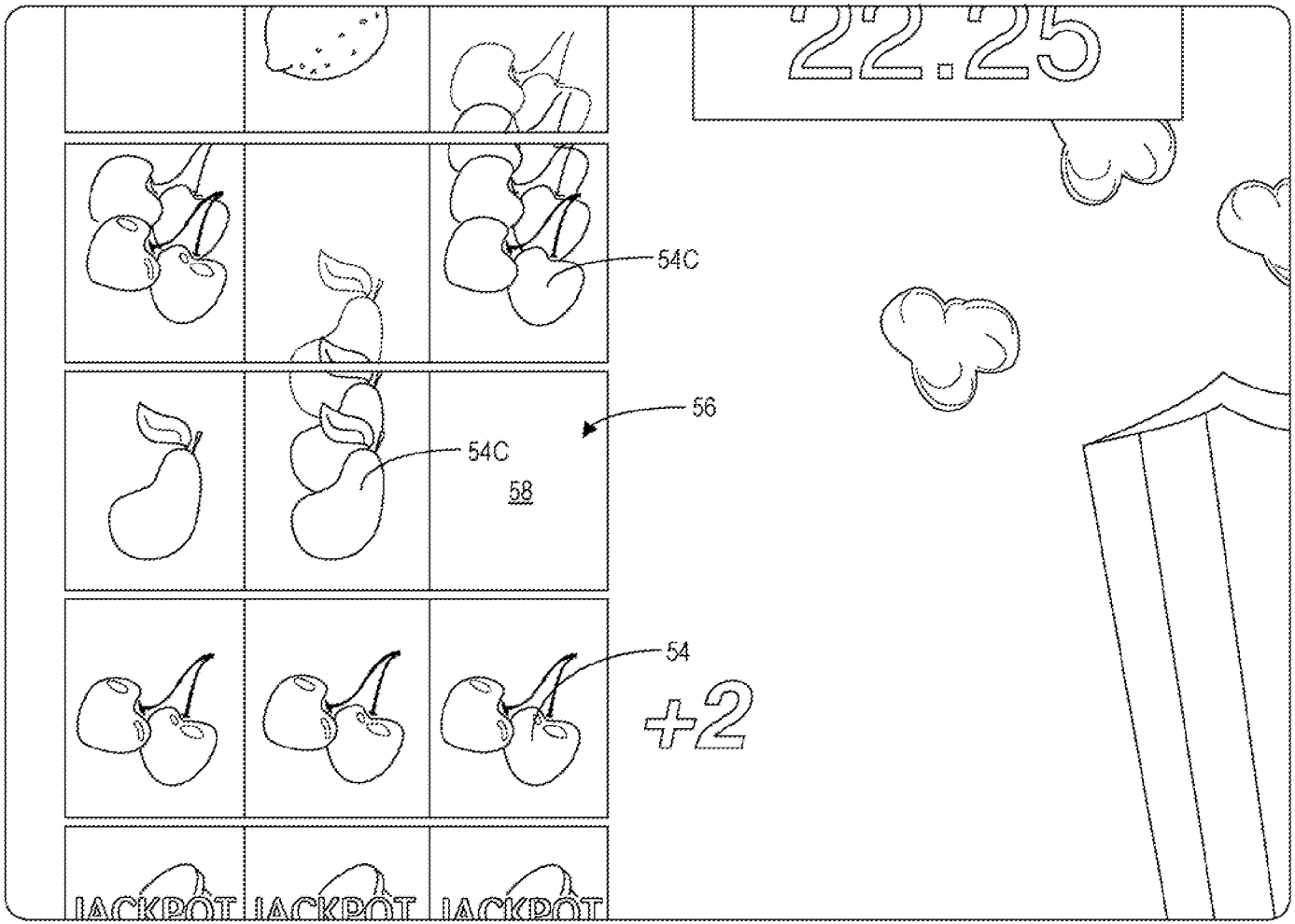
FIG. 6 illustrates a fourth exemplary screen shot for the gaming device of FIG. 1 wherein the symbols are falling into the matrix.

The popcorn icons 52 and associated symbols 54 move about the display 14 as if flying through the air (block 34), and as they fall, the symbols 54 separate from the popcorn icons 52 (block 36 and FIG. 5). The symbols 54 fall into a matrix 56 on the second display 16 (block 38 and FIG. 6). As illustrated, some symbols 54C are still "falling" into the matrix 56. The matrix 56 may be thought of as a conveyor belt of positions 58 further described below.

Figure 7:
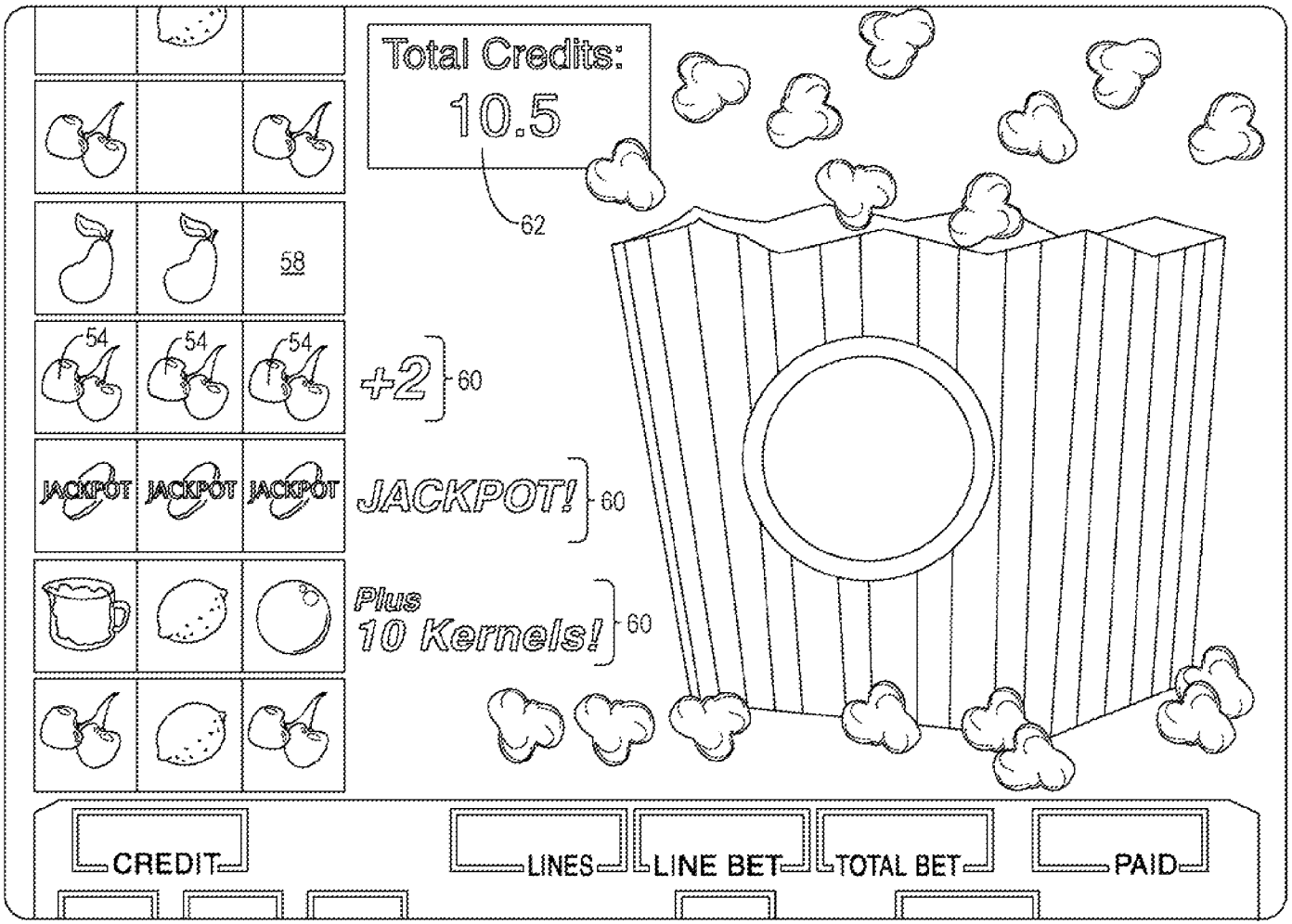
FIG. 7 illustrates a fifth exemplary screen shot for the gaming device of FIG. 1 showing the matrix and awards generated by outcomes in the matrix.

The symbols 54 in the matrix 56 form outcomes (block 40 and FIG. 7). The outcomes may be read from the rows, diagonals and columns as needed or desired. Note that some winning outcomes may be fractional outcomes if needed or desired. The outcomes are then announced (block 42), which as illustrated takes the form of a visual announcement 60. As outcomes are determined, a credit meter 62 may be updated. In the embodiment illustrated, the credit meter 62 is part of the display 16. However, the credit meter 62 could be positioned elsewhere, such as on the housing 12 as needed or desired.

Figure 8:
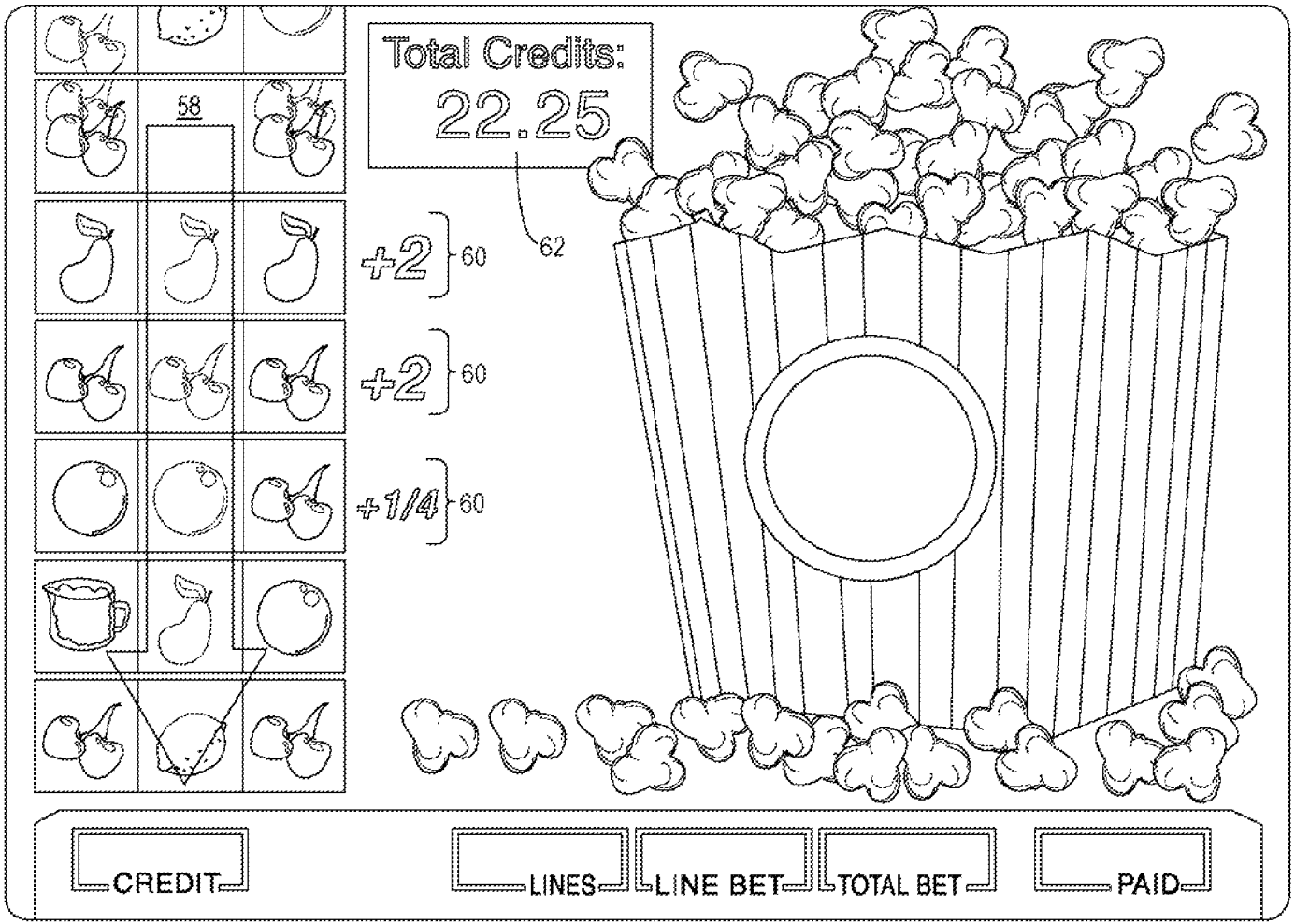
FIG. 8 illustrates a sixth exemplary screen shot for the gaming device of FIG. 1 highlighting the scrolling nature of the matrix.

As alluded to earlier, the matrix 58 may be conceptualized as a conveyor belt, and as the symbols 54 fill empty positions 58, the rows of the matrix 58 move steadily off the bottom of the display 16 (block 44 and FIG. 8). This movement may add a sense of dynamic excitement to the game as players hope that a row will be filled with the appropriate symbols 54 before it is removed from the display 16.

At the conclusion of the game (block 46), a total outcome may be presented in the credit meter 62 or at another location on the gaming device 10. The player may then choose to play again or collect her winnings and move onto a different machine as she sees fit.

In a particularly contemplated embodiment, outcomes are determined randomly and a determination is made randomly as to where to display given outcomes in the display matrix 56. There are numerous ways in which the randomness of the outcome may be assured, all of which are contemplated for use in embodiments of the present invention.

While the above process represents one embodiment of the present invention, the invention is not limited to the popcorn embodiment. Rather, the use of a scrolling matrix can be added to a gaming device as a bonus game or meta-game. Symbols from the primary game may move from the primary game to the scrolling matrix with winning outcomes on the scrolling matrix providing the bonus payouts. A more detailed explanation follows.

Figure 9:
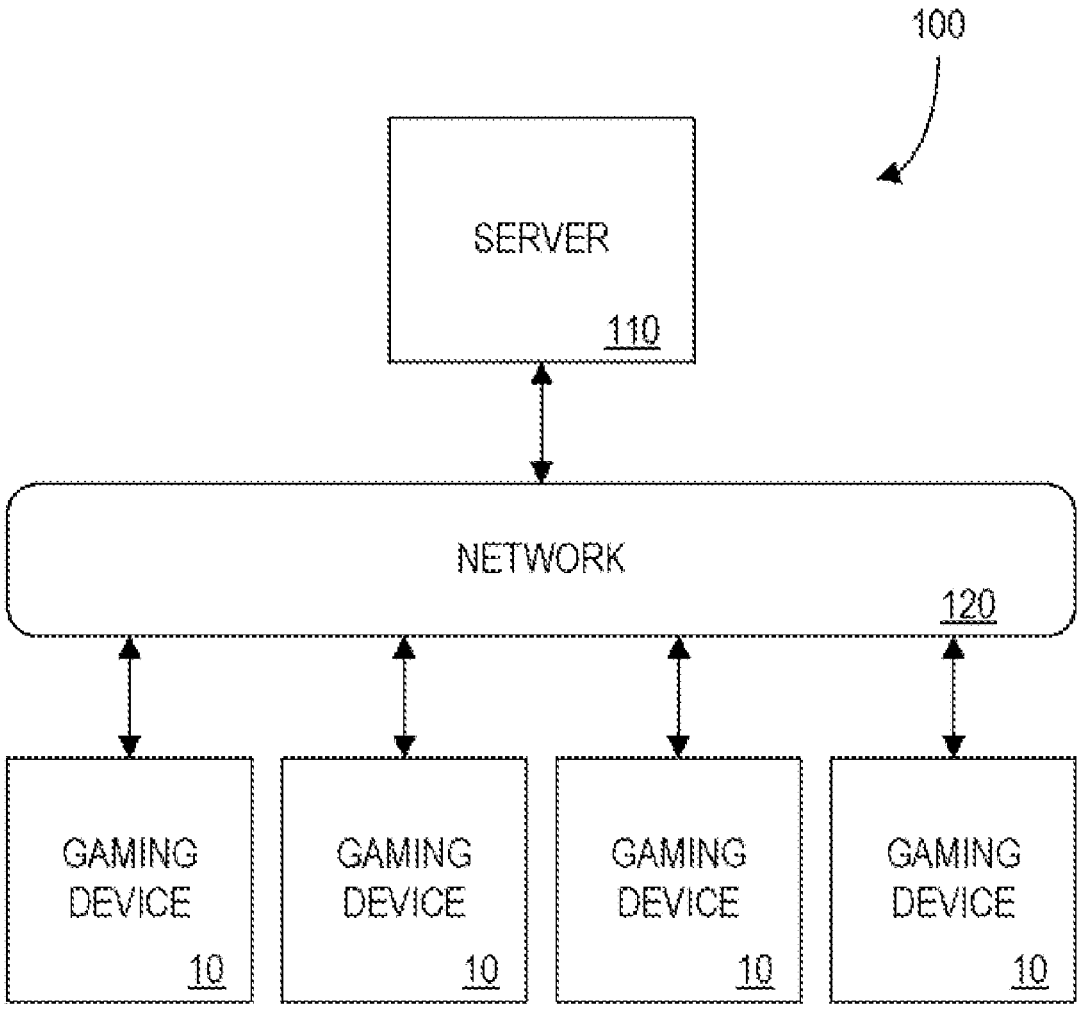
FIG. 9 illustrates an exemplary gaming establishment using one or more gaming devices according to embodiments of the present invention.

As illustrated in FIG. 9, embodiments of the present invention can be configured to work in a network environment 100 including a server 110 that is in communication, via a communication network 120 with one or more gaming devices 10. The server 110 may communicate with the gaming devices 10 directly or indirectly, via a wired or wireless medium such as the Internet, LAN, WAN, Ethernet, Token Ring, or via any appropriate communications means or combination of communications means. Any number and type of devices may be in communication with the server 110.

Those skilled in the art will understand that devices in communication with each other need not be continually transmitting to each other. On the contrary, such devices need only transmit to each other as necessary, and may actually refrain from exchanging data most of the time. In some embodiments, a server 110 may not be necessary and embodiments of the present invention may be implemented solely within a gaming device 10.

While the embodiment above illustrates the gaming device 10 as a stand alone device, alternate embodiments are not so limited. For example the gaming device 10 may comprise a personal computer connected through the web to an online casino site, a mobile terminal such as a cellular telephone, personal digital assistant, or NINTENDO® GAMEBOY™.

While the general composition and operation of the server 110 or processor of the gaming device 10 are well understood, the interested reader is referred to commonly owned U.S. Patent Application Publication No. 2006/0025207, which is incorporated by reference in its entirety, which has more detail about some of the operation of the controller and the networks.

Figure 10:
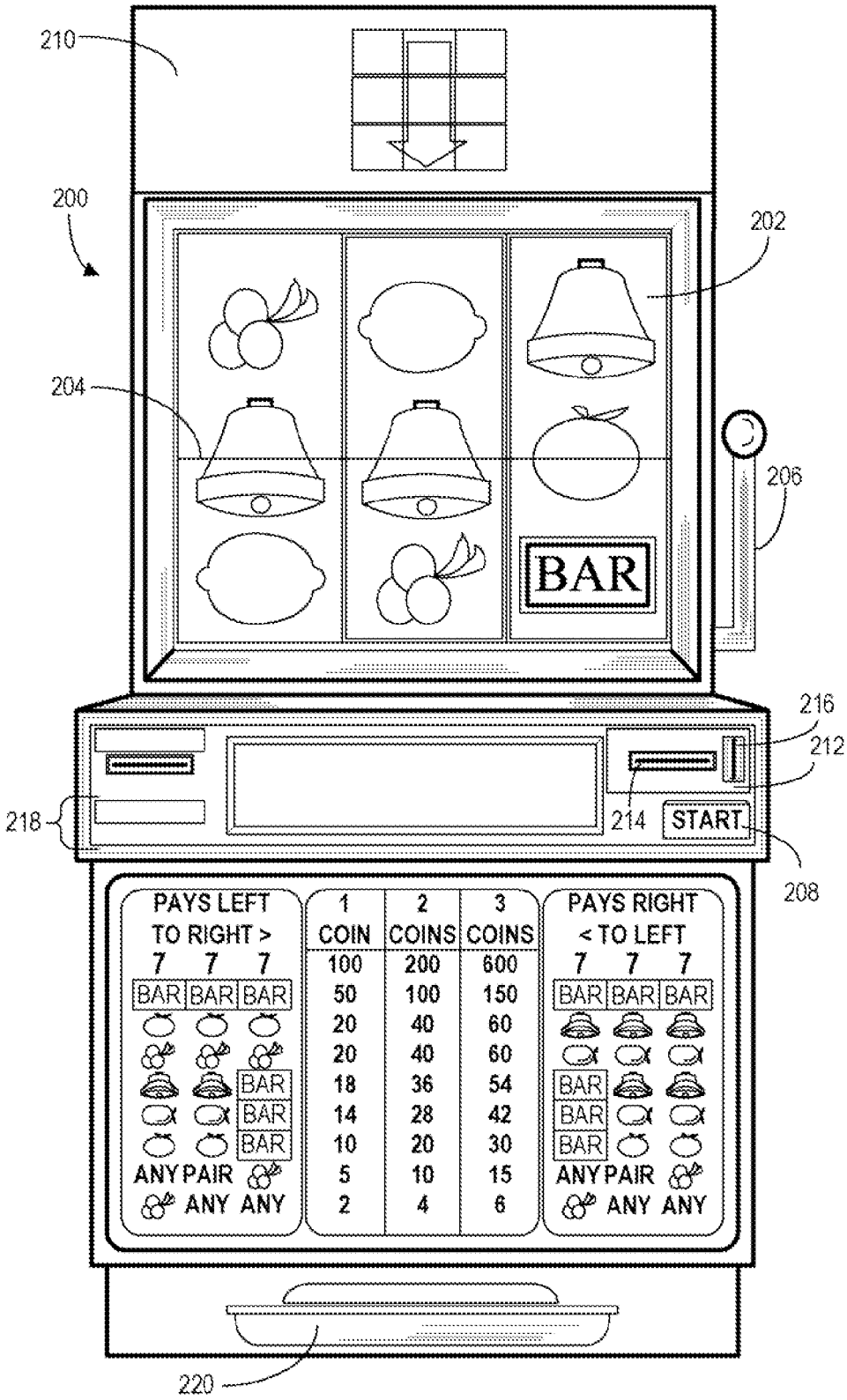
FIG. 10 illustrates a gaming device according to an alternate embodiment of the present invention.

In a particularly contemplated alternate embodiment, the gaming device 10 may take the form of a slot machine 200 as illustrated in FIG. 10. Slot machine 200 is configured to operate in conjunction with the present invention. While the slot machine 200 is illustrated as a three reel machine, a five reel slot machine also works with embodiments of the present invention. Slot machine 200 comprises a display area 202 in which an outcome for a game of the slot machine 200 may be displayed to the player. The display area 202 may, for example, be a video display that displays graphical representations of reels. The display area 202 may, in another embodiment, be glass behind which are located mechanical reels. Within the display area 202 is a payline 204. In accordance with one or more embodiments of the present invention, an outcome of a game is a set of symbols displayed along the payline 204 of the reeled slot machine 200. The slot machine may further comprise a handle 206. A player may initiate the movement of the reels in the display area 202 by pulling on the handle 206. Alternatively, the player may initiate the movement of the reels in the display area by actuating a start button 208. Either or both of the handle and start button are exemplary embodiments of an input device.

Where appropriate, the slot machine may also include an alternate, secondary game screen 210, for outputting information to the player. The secondary game screen 210 may be utilized, for example, to display the meta-game.

Slot machine 200 may include a payment system 212, which is comprised of a cash acceptor 214, a credit card reader 216, and the like. The player may utilize the payment system 212 to provide a wager for playing a game and/or for providing payment for provision of an outcome.

Slot machine 200 may further comprise a credit meter balance 218, which is an exemplary embodiment of a benefit output device. The credit meter balance 218 reflects the amount of electronic credits currently available to a player. The electronic credits may be used by the player, for example, as wagers for games played on the slot machine 200. The electronic credits may also be "cashed out" as coins, bills, tokens, a cashless gaming receipt, and/or credits to another financial account associated with the player.

Finally, the slot machine 200 may comprise a coin tray 220. Payment to the player may be rendered by dispensing coins into the coin tray 220. Such coins may be dispensed based on, for example, a player's indication that the player would like to cash out his credit meter balance and/or a payout obtained by the player as a result of playing a game on the slot machine 200. The coin tray is an exemplary embodiment of a benefit output device. Note that, where appropriate, the slot machine 200 may include different and/or additional components besides those discussed in this section.

Figure 11:
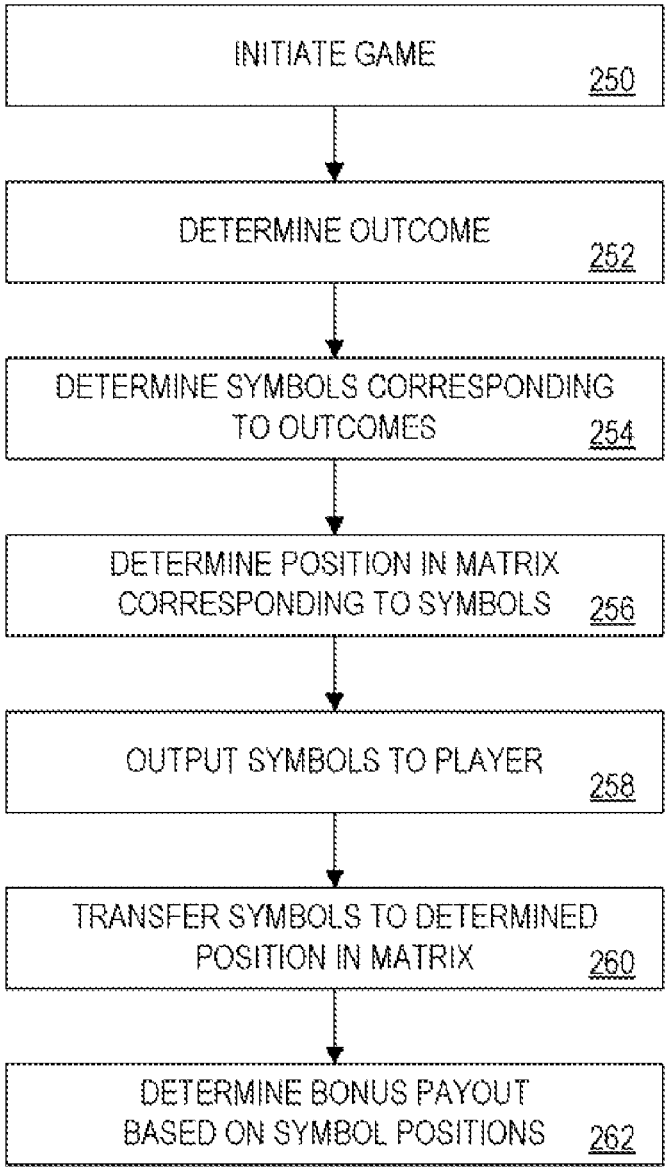
FIG. 11 illustrates a flow chart of a method for use with the gaming device of FIG. 10.

FIG. 11 illustrates an exemplary methodology for use with the slot machine 200 of FIG. 10. Note that the methodology could be applied to other gaming devices as needed or desired. In particularly contemplated embodiments, the process steps may be performed by a gaming device, a controller, devices connected to gaming devices and/or controllers (e.g., retrofitted hardware devices), or a combination of these devices.

The slot machine 200 receives a request to initiate a game by receiving a signal via an input device, such as the handle 206, the start button 208 or a button on a touch screen (block 250). Alternatively, such a request may be received via a payment accepting apparatus, for example on the deposit of currency, insertion of a credit card, or the like. Further, such a request may be received via a device configured to accept and read player-tracking cards.

A game that may be initiated may constitute a basic game and/or a meta-game. Further, the player may purchase a single handle pull or a prepaid session. Thus, a player may initiate play of a basic game and a meta-game through the purchase of a single handle pull, in which case additional symbols for use in the meta-game could be collected through the purchase of additional handle pulls. Or, the player may initiate play of both a basic game and a meta-game through the purchase of a prepaid session, in which case, individual outcomes may yield basic payouts, and aggregated symbols 54 may be collected (through placement of such symbols 54 in a matrix 56) throughout the session and be used to determine bonus payout eligibility. Further, the player may initiate play of a meta-game through the purchase of a prepaid session, in which case, a basic game may not be simultaneously initiated (i.e., only a bonus payout can be awarded through a combination of aggregated symbols).

A subroutine may optionally be employed at this juncture for confirming the player's desire to play a game or meta-game. For example, a confirmation screen may be shown to the player via a display device which prompts the player to (i) view or listen to instructional material, (ii) acknowledge the rules of the game or meta-game, (iii) accept the terms of a contractual offer, or (iv) any combination thereof. Such a confirmation subroutine may be particularly desirable in meta-game embodiments employing prepaid session functionality. A more detailed description of systems and methods for providing a confirmation screen to a player are disclosed in U.S. patent application Ser. No. 10/791,028 filed Mar. 2, 2004 and published as WO2004/078289, the entirety of which is incorporated by reference herein.

Once a game is initiated, the slot machine 200 randomly determines an outcome or plurality of outcomes using the means and methods described herein (block 252). For example, a single outcome may result from a single handle pull. Or a plurality of outcomes may result upon the initiation of a prepaid session, such as, for example, in an embodiment where a prepaid session initiates a popcorn-themed meta-game whereby a plurality of outcomes are determined.

In some embodiments, determination of an outcome or outcomes at this step can be accompanied by a determination of payout eligibility. For example, in an embodiment where a prepaid session initiates a popcorn-themed meta-game comprising a plurality of outcomes, each individual outcome may potentially yield a payout. Or, in a basic game, each handle pull may result in a payout.

Once random outcomes are determined, symbols 54 corresponding to the outcomes are determined (block 254). As described herein, outcomes may be associated with (i) individual symbols 54 that independently can be used to determine payout eligibility (e.g., a single cherry symbol 54 outcome yields a payout), and/or (ii) a plurality of individual symbols 54 that are used to determine payout or bonus payout eligibility (e.g., a cherry-cherry-cherry outcome in a basic slot machine 200, or the aggregation of three cherries in a meta-game). For example, in the embodiments described herein, a single outcome may correspond to a single symbol 54. Or, as in the case of the another embodiment, a single outcome may correspond with multiple symbols 54.

It should be noted that, in some embodiments, blocks 252 and 254 may be combined so that determination of a random outcome necessarily determines a symbol 54. For example, rather than utilizing a random number generator to determine a random number which is in turn used to determine a corresponding symbol 54 in a relational database, the randomization may simply yield a selection of one or more of several symbols 54.

Once symbols 54 are determined, a determination is made as to where to position such symbols 54 in the display matrix 56 (block 256). This determination may be made randomly as needed or desired such as through a random number generator. Alternatively, this determination may be made based on rules that consider the position of previously accumulated symbols 54. For example, stored rules retrievable by the processor from a data storage device may dictate that: (1) subsequently generated symbols 54 cannot replace previously generated symbols 54 in the matrix 56; (2) unless occupied by other previously generated symbols 54, symbols 54 should be placed in the row position closest to similar, previously generated symbols in the matrix 56 (e.g., cherry symbols should be placed as close as possible to other cherry symbols, and in the same row of the matrix 56); and/or (3) symbols should be situated in the matrix 56 so as to provide the player with the maximum payout (i.e., symbols should be combined according to stored rules in a way that maximized payouts). In another embodiment, this determination may be made based on a previous determination in a multi-symbol outcome. In this embodiment, a multi-symbol outcome (e.g., cherry-bar-plum) is initially determined at blocks 252 and/or 254. Then, at block 256, the originally determined multi-symbol outcome configuration is retrieved from memory so that the system can determine where in the matrix 56 to place visually the individual symbols 54 of the multi-symbol outcome.

The determined symbols are then output to the player (block 258) such as through the display 210. The individual symbols 54 of the multi-symbol outcome are each displayed to the player so that the player cannot initially determine the ultimate relative position of the individual outcome symbols 54. For example, the individual symbols 54 may be serially revealed to the player. Or the symbols 54 may be simultaneously displayed in a scrambled fashion. Given the slot machine nature of slot machine 200, the symbols 54 are displayed on the payline 204. It should be noted that, alternatively, the determination of a symbol 54 position on the matrix 56 may follow the step of outputting the symbol 54 to the player.

The symbols 54 are then transferred to determined positions 58 within the matrix 56 (block 260). Using any technique to show movement, the symbols 54 are then transferred to the determined positions 58 in the matrix 56.

Once at least two symbols 54 are in the matrix 56, a determination is made as to bonus payout eligibility (block 262). To determine bonus payout eligibility, a stored set of rules may be retrieved from a database or otherwise referenced from a memory. Such stored rules may indicate the various payouts that are to be awarded to the player for the various combinations of the various symbols 54 that were placed in the matrix 56 previously. For example, stored rules may indicate that: (1) three pear symbols 54 occurring in a single row of the matrix 56 yields two points, (2) three cherry symbols 54 occurring on a single row of the matrix 56 yields three points, (3) a diagonal line of three cherry symbols 54 occurring anywhere on the matrix 56 yields five points, and (4) a total of fifty points in a game session qualifies the player for a $200 bonus payout. Alternatively, individual combinations of symbols 54 may directly yield bonus payouts. For example, three cherry symbols 54 occurring on a single row may yield a bonus payout of $5.

Once payout eligibility is determined, a payout may be actuated at the slot machine 200 in a manner known in the art. For example, an appropriate amount of coins may be dispensed from coin tray 220.

Further discussion of the scrolling matrix 56 is merited. In some embodiments, the matrix 56 may be a scrolling matrix 56, and may optionally be communicated to the player a "conveyor belt". A scrolling matrix 56 functions to institute a time limit associated with accumulated outcomes, such that if a given row of the matrix 56 is not filled by the necessary complementary symbols 54 by the time the row disappears from the display 16 or 210, the player loses any accumulated symbols 54 in that row. In effect, as the new rows are filled, the old rows are bumped off. The expiration of aggregated symbols in a meta-game is explained in detail in: (1) U.S. Provisional patent application Ser. No. 60/445,473 entitled "Electronic Amusement Device and Method for Enhanced Slot Machine Play" filed Feb. 5, 2003, which matured into U.S. patent application Ser. No. 10/772,837, (2) U.S. Provisional patent application Ser. No. 60/447,265 entitled "Electronic Amusement Device and Method for Enhanced Slot Machine Play" filed Feb. 13, 2003, which matured into U.S. patent application Publication No. 2004/0162134, and (3) U.S. patent application Ser. No. 09/716,918, which is a continuation of U.S. Pat. No. 6,203,430.

In some embodiments, a peripheral device may be operatively connected to a gaming device that is configured to assist in the operation of functions related to basic games and/or meta-games. A peripheral device may include a processor that can communicate with a processor of a gaming device. Further, a peripheral device may have one or more output devices, such as display screens, and one or more input devices, such as buttons. Examples of peripheral devices include (1) electronic apparatuses "retrofitted" to conventional gaming devices so that inventive processes disclosed herein may be realized through game play at such gaming devices, (2) personal digital assistants (PDAs) such as those manufactured by Palm, Inc. (3) laptop computers, (4) cellular telephones, (5) pagers, or (6) any combination thereof.

It should be noted that the embodiments described with reference to the figures are presented for illustrative purposes only and are not meant to be limiting in any sense. It should also be noted that, as used herein, the terms "first embodiment", "second embodiment", "third embodiment", "an embodiment", "embodiment", "embodiments", "the embodiment", "the embodiments", "one or more embodiments", "some embodiments", and "one embodiment" mean one or more embodiments unless expressly specified otherwise. Further, although particular features of the present invention may be described with reference to one ore more particular embodiments or figures, it should be understood that such features are not limited to usage in the one or more particular embodiments or figures with reference to which they are described.

Further, it should be noted that although process steps, method steps, algorithms, or the like may be described in sequential order, such processes, methods, and algorithms may be configured to work in alternate orders. In other words, any sequence or order of steps that may be described does not necessarily indicate a requirement that the steps be performed in that order.

In conclusion, while methods and apparatus of the present invention have been described in terms of particular embodiments, those skilled in the art will recognize that the present invention may be practiced with modification and alteration without departing from the teachings disclosed herein.

What is claimed is:

1. A method comprising:

implementing a round of game play at a gaming device by:

randomly generating and displaying a first plurality of symbols;

thereafter, randomly determining at least a second plurality of symbols from the first plurality of symbols to position within a matrix, the matrix including a plurality of positions and the second plurality of symbols being less than the first plurality of symbols;

for each of the second plurality of symbols, display said symbol in association with one of the positions of the matrix;

determining a first outcome based on an evaluation of the symbols displayed in association with the positions of the matrix;

providing a payout based on the determined first outcome; and after determining the first outcome:

(i) during the round of the game play, scrolling the matrix, such that at least one of the symbols associated with one of the positions of the matrix is not evaluated for a subsequently determined second outcome in the round of game play;

(ii) displaying at least one additional symbol in association with one of the positions of the matrix; and (iii) after scrolling the matrix, determining said second outcome based on an evaluation of the symbols displayed in association with the positions of the matrix, said evaluation including an evaluation of: (A) at least one of the symbols evaluated when determining said first outcome, and (B) said at least one additional symbol.

2. The method of claim 1 wherein the second plurality of symbols comprises a subset of the first plurality of symbols.

3. The method of claim 1 wherein generating the first plurality of symbols comprises selecting symbols from symbols displayed on slot machine reels.

4. The method of claim 1 wherein conducting game play at the gaming device comprises conducting a basic game and a meta-game.

5. The method of claim 4 wherein generating the first plurality of symbols comprises generating the first plurality of symbols as part of the basic game.

6. The method of claim 5 wherein positioning each of the second plurality of symbols within the matrix forms part of the meta-game.

7. The method of claim 6 further comprising awarding a payout for the basic game based on outcomes of the basic game.

8. The method of claim 6 further comprising providing a bonus payout for the meta-game based on one or more of the symbols displayed in association with positions of the matrix.

9. The method of claim 8 further comprising providing a bonus payout if symbols displayed in association with positions of the matrix are arranged in positions within a predetermined row or positions arranged in a diagonal manner.

10. The method of claim 1 wherein scrolling the matrix comprises scrolling the matrix from a top of a display to a bottom of the display.

11. A gaming device comprising:

a display device;

a user interface; and a controller operatively coupled to the display device and the user interface and adapted, for a round of game play at the gaming device, to:

randomly generate a first plurality of symbols;

display the first plurality of symbols on the display device;

thereafter, randomly determine a second plurality of symbols from the first plurality of symbols, the second plurality of symbols being less than the first plurality of symbols;

for each of the second plurality of symbols, display said symbol in association with one of a plurality of positions of a matrix, the matrix being displayed by the display device;

determine a first outcome based on an evaluation of the symbols displayed in association with the positions of the matrix provide a payout based on the first outcome; and after determining the first outcome:

(i) during the round of the game play, scroll the matrix such that at least one of the symbols displayed in association with a position of the matrix is not evaluated for a subsequently determined second outcome in the round of game play;

(ii) display at least one additional symbol in association with one of the positions of the matrix; and (iii) after scrolling the matrix, determine said second outcome based on an evaluation of the symbols displayed in association with the positions of the matrix, said evaluation including an evaluation of: (A) at least one of the symbols evaluated when determining said first outcome, and (B) said at least one additional symbol.

12. The gaming device of claim 11 wherein the display device comprises a first display and a second display.

13. The gaming device of claim 12 wherein the controller adapted to display the first plurality of symbols on the display device is adapted to cause the first plurality of symbols to be displayed on the first display.

14. The gaming device of claim 11 wherein the controller is further adapted to provide a basic game and a meta-game to a player through the use of the symbols.

15. The gaming device of claim 11 wherein the controller adapted to display the first plurality of symbols on the display device causes symbols to be displayed as part of a reel in a slot machine style game.

16. The gaming device of claim 11 wherein the gaming device comprises a mobile terminal.

17. A method of operating a gaming device including a plurality of instructions, the method comprising:

in a basic game, causing a processor to randomly determine a plurality of symbols;

causing a display device to display the plurality of symbols;

thereafter, causing the processor to execute the plurality of instructions to randomly determine a first outcome for the basic game based on at least a portion of the plurality of symbols;

causing the processor to randomly determine a subset of the plurality of symbols to position within a matrix, the matrix including a plurality of positions and the subset including at least one but less than all of the plurality of symbols;

for each of the symbols of the subset of symbols, causing the display device to display said symbol in association with one of the positions of the matrix;

determining a first outcome of a meta-game based on an evaluation of the symbols displayed in association with the positions of the matrix; and after the determination of the first outcome:

(i) during the meta-game, moving the matrix as symbols are displayed in association with the positions of the matrix, such that at least one of the symbols previously displayed in association with a first one of the positions of the matrix is displayed in association with a second, different one of the positions of the matrix, and at least one of the symbols previously displayed in association with a third one of the positions of the matrix is not evaluated for a subsequently determined second outcome of the meta-game;

(ii) causing the display device to display at least one additional symbol in association with one of the positions of the matrix; and (iii) after moving the matrix, causing the processor to execute the plurality of instructions to determine the second outcome of the meta-game based on an evaluation of the symbols displayed in association with the positions of the matrix, said evaluation including an evaluation of: (A) at least one of the symbols evaluated when determining said first outcome, and (B) said at least one additional symbol.

18. The method of claim 17 wherein moving the matrix comprises scrolling the matrix.

* * * * *

UNITED STATES PATENT AND TRADEMARK OFFICE

CERTIFICATE OF CORRECTION

PATENT NO. : 7,914,376 B2
APPLICATION NO. : 11/426457
DATED : March 29, 2011
INVENTOR(S) : Walker et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 665 days.

IN THE CLAIMS:

In Claim 11, column 10, line 13, after “matrix” insert --;--.

Signed and Sealed this
Fifth Day of July, 2011

David J. Kappos

David J. Kappos
*Director of the United States Patent and Trademark Office*